US011795733B2

(12) United States Patent
Huang

(10) Patent No.: US 11,795,733 B2
(45) Date of Patent: Oct. 24, 2023

(54) KNOB-LESS HORIZONTAL-SHIFT FIRE DOOR LOCK

(71) Applicant: Shen-Fu Huang, Taipei (TW)

(72) Inventor: Shen-Fu Huang, Taipei (TW)

( * ) Notice: Subject to any disclaimer, the term of this patent is extended or adjusted under 35 U.S.C. 154(b) by 1 day.

(21) Appl. No.: 17/840,642

(22) Filed: Jun. 15, 2022

(65) Prior Publication Data

US 2023/0027980 A1 Jan. 26, 2023

(30) Foreign Application Priority Data

Jul. 23, 2021 (TW) ..... 110208678

(51) Int. Cl.
*E05B 65/10* (2006.01)
*E05B 15/04* (2006.01)

(52) U.S. Cl.
CPC ..... *E05B 65/1046* (2013.01); *E05B 15/04* (2013.01); *E05B 65/1053* (2013.01); *E05B 65/1093* (2013.01); *E05B 2015/0455* (2013.01)

(58) Field of Classification Search
CPC ..... E05B 65/1046; E05B 65/1053; E05B 65/1093; E05B 2015/0455; E05B 15/04
See application file for complete search history.

(56) References Cited

U.S. PATENT DOCUMENTS 1,539,350 A * 5/1925 Clark ..... E05B 65/1073 70/92
1,605,989 A * 11/1926 Rucker ..... E05B 65/1073 292/164
2,436,769 A * 2/1948 Hardie ..... E05C 1/14 292/170
3,317,230 A * 5/1967 Demrick ..... E05C 19/08 292/281
3,614,145 A * 10/1971 Zawadzki ..... E05B 65/1053 292/201
5,011,199 A * 4/1991 Lowe ..... E05B 65/1093 292/DIG. 65
5,029,916 A * 7/1991 Chiu ..... E05B 1/0038 292/336.3
5,169,185 A * 12/1992 Slaybaugh ..... E05B 65/1053 292/92
5,465,191 A * 11/1995 Nomura ..... E05C 1/10 361/740

(Continued)

*Primary Examiner* — Christine M Mills
*Assistant Examiner* — Faria F Ahmad
(74) *Attorney, Agent, or Firm* — Leong C. Lei

(57) ABSTRACT

A knob-less horizontal-shift fire door lock includes a base including a longitudinal bar, an unlocked-state positioning member arranged in the longitudinal bar and having a positioning section; a latch pivoted to the base and having a free end elastically biased outside the base to engage a keeper on a door jamb; a push board pivoted in the base; and a handle bar slidably mounted on the longitudinal bar. The handle bar is biased by an elastic element to protrude outwards and moving a guide pin to slide in a guide groove of the positioning section. The handle bar is depressible toward the longitudinal bar to move the push board to drive the latch to retract into the base to achieve an unlocked state. The handle bar is further shiftable horizontally to cause the guide pin to slide into a horizontal groove of the positioning section for being secured in position.

11 Claims, 8 Drawing Sheets

(56) References Cited

U.S. PATENT DOCUMENTS 7,070,210 B2 * 7/2006 Lin ..... E05B 65/104 292/93
7,712,800 B2 * 5/2010 Peng ..... E05B 17/007 292/DIG. 65
8,434,794 B2 * 5/2013 Sijmons ..... A45C 13/18 292/26
2004/0183311 A1 * 9/2004 Lin ..... E05B 65/104 292/92
2006/0006666 A1 * 1/2006 Lin ..... E05B 1/0092 292/200
2006/0082162 A1 * 4/2006 Escobar ..... E05B 65/1053 292/201
2006/0261608 A1 * 11/2006 Rusiana ..... E05C 1/14 292/336.3
2007/0029819 A1 * 2/2007 Kitzis ..... E05C 19/18 292/304
2008/0106104 A1 * 5/2008 Lin ..... E05B 63/0065 292/92
2008/0179894 A1 * 7/2008 Chuang ..... E05C 3/06 292/109
2008/0211238 A1 * 9/2008 Stevens ..... E05B 47/0607 292/144
2009/0174194 A1 * 7/2009 Tien ..... E05B 65/1053 292/92
2010/0043505 A1 * 2/2010 Tien ..... E05B 65/1053 70/92
2013/0001960 A1 * 1/2013 Tien ..... E05B 17/2003 292/96
2014/0102155 A1 * 4/2014 Lin ..... E05C 9/046 70/92
2014/0109479 A1 * 4/2014 Morstatt ..... E05B 65/1093 292/144
2014/0239650 A1 * 8/2014 Kato ..... E05B 85/14 292/336.3
2018/0148955 A1 * 5/2018 Yalamati ..... E05B 17/0041
2023/0228133 A1 * 7/2023 Chen ..... E05B 79/06 292/336.3

* cited by examiner

KNOB-LESS HORIZONTAL-SHIFT FIRE DOOR LOCK

TECHNICAL FIELD OF THE INVENTION

The present invention relates generally to a fire door lock.

DESCRIPTION OF THE PRIOR ART

For fire safety, fire doors are commonly installed in stairwells of buildings to prevent spreading of flames and smokes in fires. The fire doors are normally kept in a locked state by a lock, and in emergency, escaping persons may unlock the fire door by directly pushing the door lock from the inside. The door lock can be set in a normally unlocked state by turning a knob. The mode of operation by which turning the knob commonly adopts is that an operator pushes open the fire door with one hand and, simultaneously, carries out an operation of turning the knob with the other hand. This is not ergonomic. The operation is quite effort-consuming. Apparently, further improvement is necessary.

In order to alleviate the above problems, the present invention aims to provide a knob-less horizontal-shift fire door lock.

SUMMARY OF THE INVENTION

An objective of the present invention is to provide a knob-less horizontal-shift fire door lock, which comprises a base, which comprises a longitudinal bar, at least one unlocked-state positioning member being arranged in a range of the longitudinal bar, each of the at least one unlocked-state positioning member being provided with at least one positioning section, the at least one positioning section being formed of a horizontal groove and a guide groove that are set in communication with each other as a group, the horizontal groove being parallel to the longitudinal bar, an included angle being formed between the horizontal groove and the guide groove; a latch, which is pivotally mounted, by means of a pivot pin, to a first end of the base, the latch being biased and elastically supported by a spring, such that a part of a free end of the latch is normally biased out of the base; a push board, which is pivotally mounted, at a middle section thereof, in the base by an axle; and a handle bar, which is slidably mounted on the longitudinal bar, the handle bar being at least provided with one guide pin, the guide pin being movable in unison with the handle bar, the guide pin extending through the positioning section, the handle bar being normally biased by at least one elastic element to eject outwards and moving the guide pin to slide into the guide groove, wherein the handle bar is depressible in a direction toward the longitudinal bar and the first end of the handle bar is caused to push and move a second end of the push board such that a first end of the push board is moved to drive the latch to retract inwards into the base to achieve an unlocked state, and the guide pin is caused to slide along the guide groove toward an entry opening of the horizontal groove, wherein the handle bar is horizontally shiftable to cause the guide pin to further slide into the horizontal groove to have the handle bar locked in position and keeping the latch staying in the unlocked state. As such, the knob-less horizontal-shift fire door lock according to the present invention is such that an operator uses the same hand that pushes and depresses down the handle bar to horizontally move and shift the handle bar to set the latch in a locked position. Thus, there is no need to change hand posture in operation, making it extremely ergonomic, and this demonstrates novelty and inventiveness of the present invention.

In the knob-less horizontal-shift fire door lock according to the present invention, the latch comprises a push surface, and the push surface is located on a moving path of the first end of the push board.

In the knob-less horizontal-shift fire door lock according to the present invention, the push board is provided with a roller rotatably mounted to the second end thereof to be in rolling contact engagement with an inner side of the handle bar at the first end thereof.

In the knob-less horizontal-shift fire door lock according to the present invention, the inner side of the handle bar is provided, on a portion thereof in contact engagement with the roller, with a pad for contact engagement with the roller.

In the knob-less horizontal-shift fire door lock according to the present invention, the included angle formed between the horizontal groove and the guide groove is less than or equal to 90 degrees.

In the knob-less horizontal-shift fire door lock according to the present invention, a torsion spring is further included, and the torsion spring is mounted on the unlocked-state positioning member by a locating pin, the torsion spring comprising a first spring segment and a second spring segment, wherein the first spring segment is supported on a fixed object, and the second spring segment elastically supports the guide pin in order to normally bias and push the guide pin outwards so as to also bias and elastically push the handle bar. The second spring segment is formed with a positioning notch, so that when the guide pin slides to a top end of the guide groove, the guide pin falls into the positioning notch.

In the knob-less horizontal-shift fire door lock according to the present invention, at least one return spring is arranged between the longitudinal bar and the handle bar, and the return spring normally biases the handle bar outwards.

In the knob-less horizontal-shift fire door lock according to the present invention, the push board is normally acted upon by a spring so as to drive the second end of the push board to get into contact engagement with an inner side of the first end of the handle bar.

In the knob-less horizontal-shift fire door lock according to the present invention, the base is provided, in the range of the longitudinal bar, with two or more than two unlocked-state positioning members.

An embodiment of the present invention will become apparent from the following description and the attached drawings.

DETAILED DESCRIPTION OF THE PREFERRED EMBODIMENT

Figure 4:
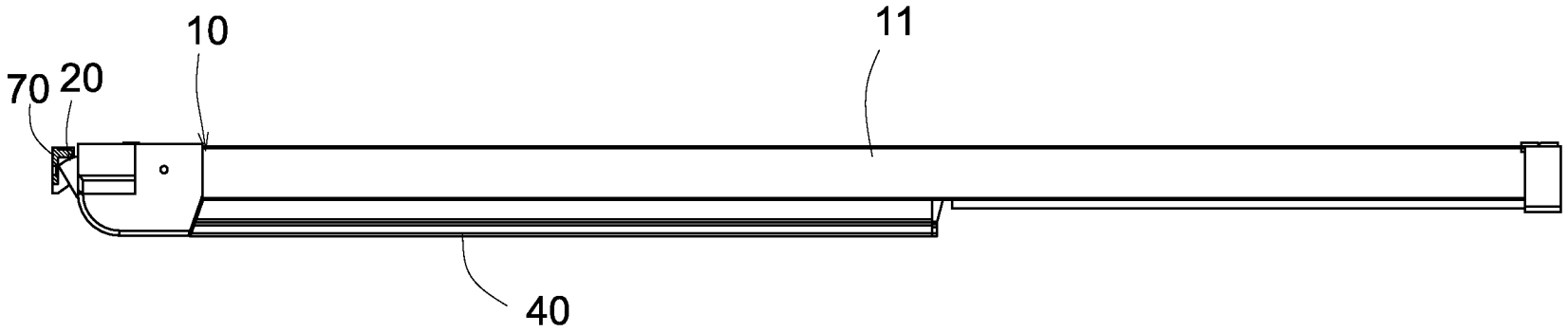
FIG. 4 is a top plan view showing the present invention.
Figure 5:
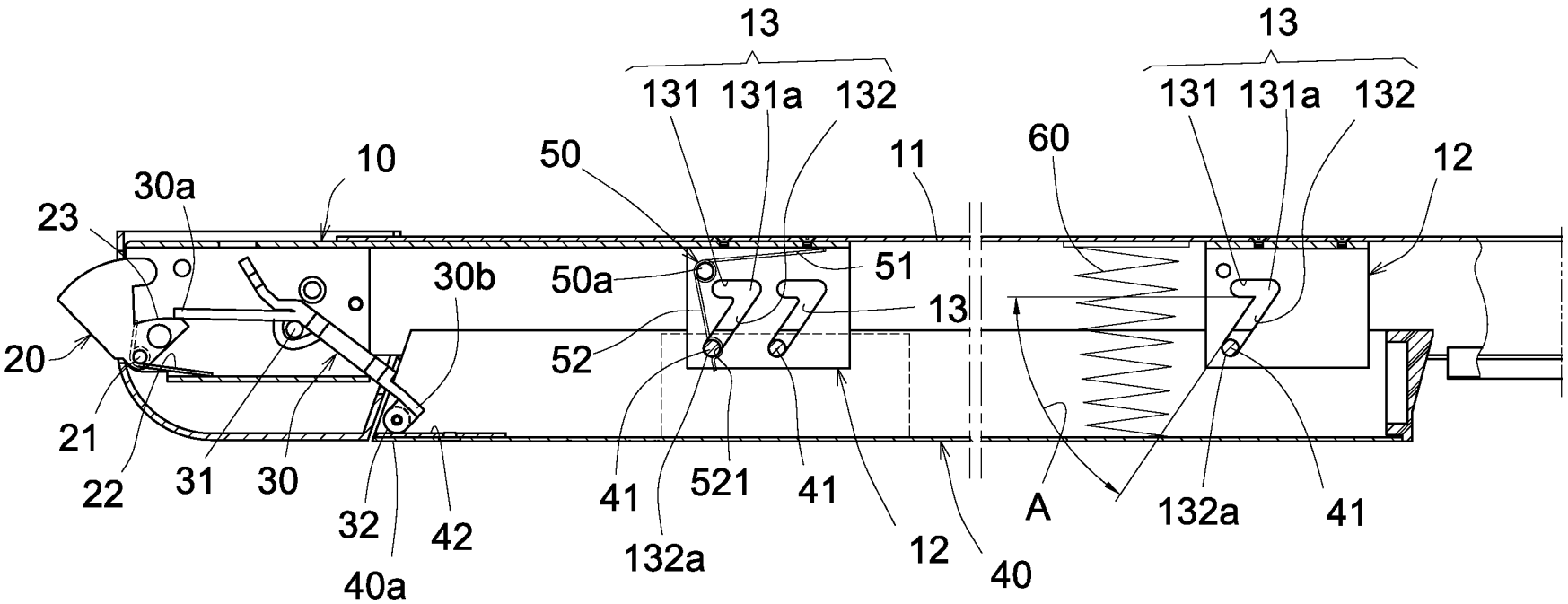
FIG. 5 is a cross-sectional view taken along line 5-5 of FIG. 1, showing a part of the present invention.
Figure 6:
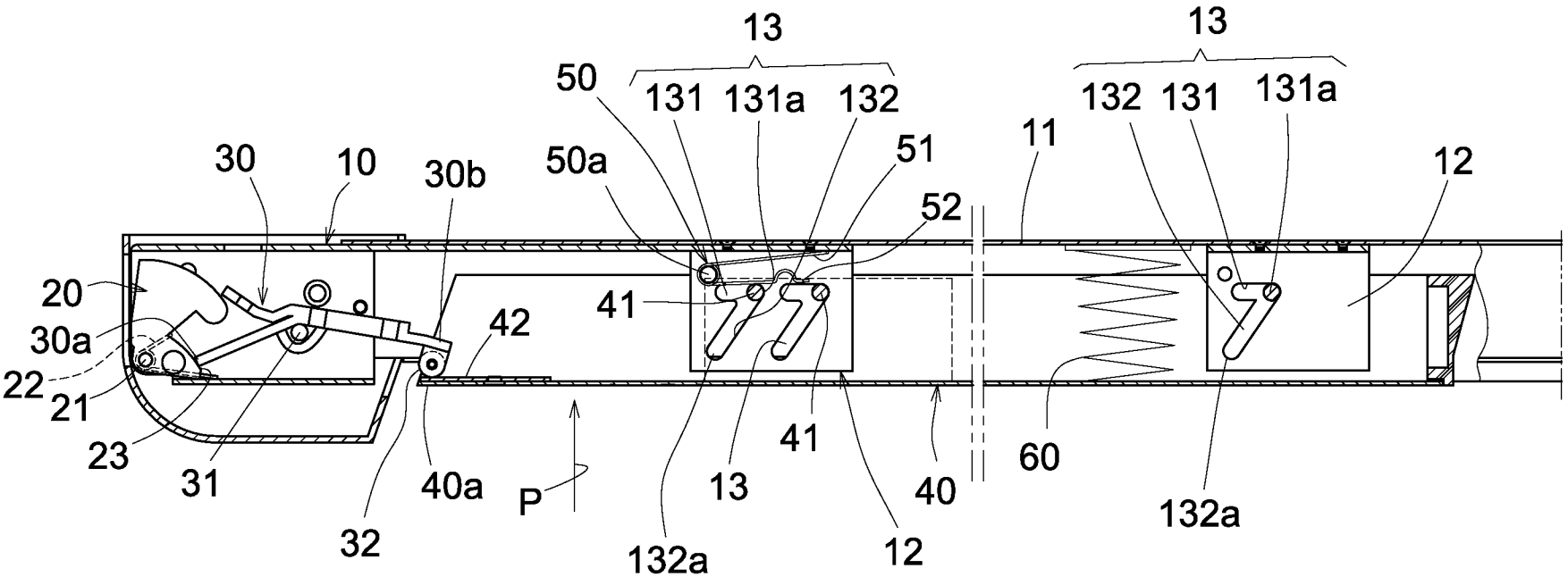
FIG. 6 is a schematic view showing an unlocked state by pressing down a handle bar of FIG. 5.

Referring to FIGS. 1-8, the present invention relates to a knob-less horizontal-shift fire door lock, which comprises: a base 10, which comprises a longitudinal bar 11, at least one unlocked-state positioning member 12 being arranged in a range of the longitudinal bar 11, each unlocked-state positioning member 12 being provided with at least one positioning section 13, the positioning section 13 being formed of a horizontal groove 131 and a guide groove 132 that are in communication with each other as being arranged as a group, the horizontal groove 131 being parallel to the longitudinal bar 11, an included angle A being formed between the horizontal groove 131 and the guide groove 132; a latch 20, which is pivotally mounted, by means of a pivot pin 21, to a first end of the base 10, the latch 20 being biased and elastically pushed by a spring 22, such that a part of a free end of the latch 20 normally projects out of the base 10 to extend into a keeper 70 mounted to a door jamb for locking operation in door closing; a push board 30, which is pivotally mounted, at a middle section thereof, in the base 10 by means of an axle 31; and a handle bar 40, which is slidably mounted to the longitudinal bar 11, the handle bar 40 comprising at least one guide pin 41, the guide pin 41 being displaceable or shiftable in unison with the handle bar 40, the guide pin 41 being extended through the positioning section 13, the handle bar 40 being normally biased and elastically pushed outward by at least one elastic element to drive the guide pin 41 to locate, in a slidable manner, in the guide groove 132, wherein the handle bar 40 is pushable in a direction toward the longitudinal bar 11, such that a first end 40*a* of the handle bar 40 pushes and moves a second end 30*b* of the push board 30 to drive a first end 30*a* of the push board 30 to push and move the latch 20 and drive the latch 20 to retract back into the base 10 to achieve an unlocked state as shown in FIG. 6, and also to cause the guide pin 41 to slide along the guide groove 132 to move toward an entry opening 131*a* of the horizontal groove 131, wherein further pushing the handle bar 40 in P direction shown in FIG. 6 causes the guide pin 41 to slide into the horizontal groove 131 and thus lock up the handle bar 40, wherein even the operator releases the handle bar 40, since the guide pin 41 is located in the horizontal groove 131, the handle bar 40 is prevented from being elastically ejecting outwards in a direction perpendicular to the horizontal groove 131, and is thus secured stably in a securely-positioned state, and consequently keeping the latch 20 in the unlocked state.

In the knob-less horizontal-shift fire door lock disclosed in the present invention, the latch 20 comprises a push surface 23, and the push surface 23 is arranged to locate in a moving path of the first end 30*a* of the push board 30, so that when the push board 30 rotates about the axle 31, the first end 30*a* of the push board 30 is in contact engagement with the push surface 23 so as to cause the latch 20 to retract back into the base 10 through rotation about a center defined by the pivot pin 21.

Figure 1:
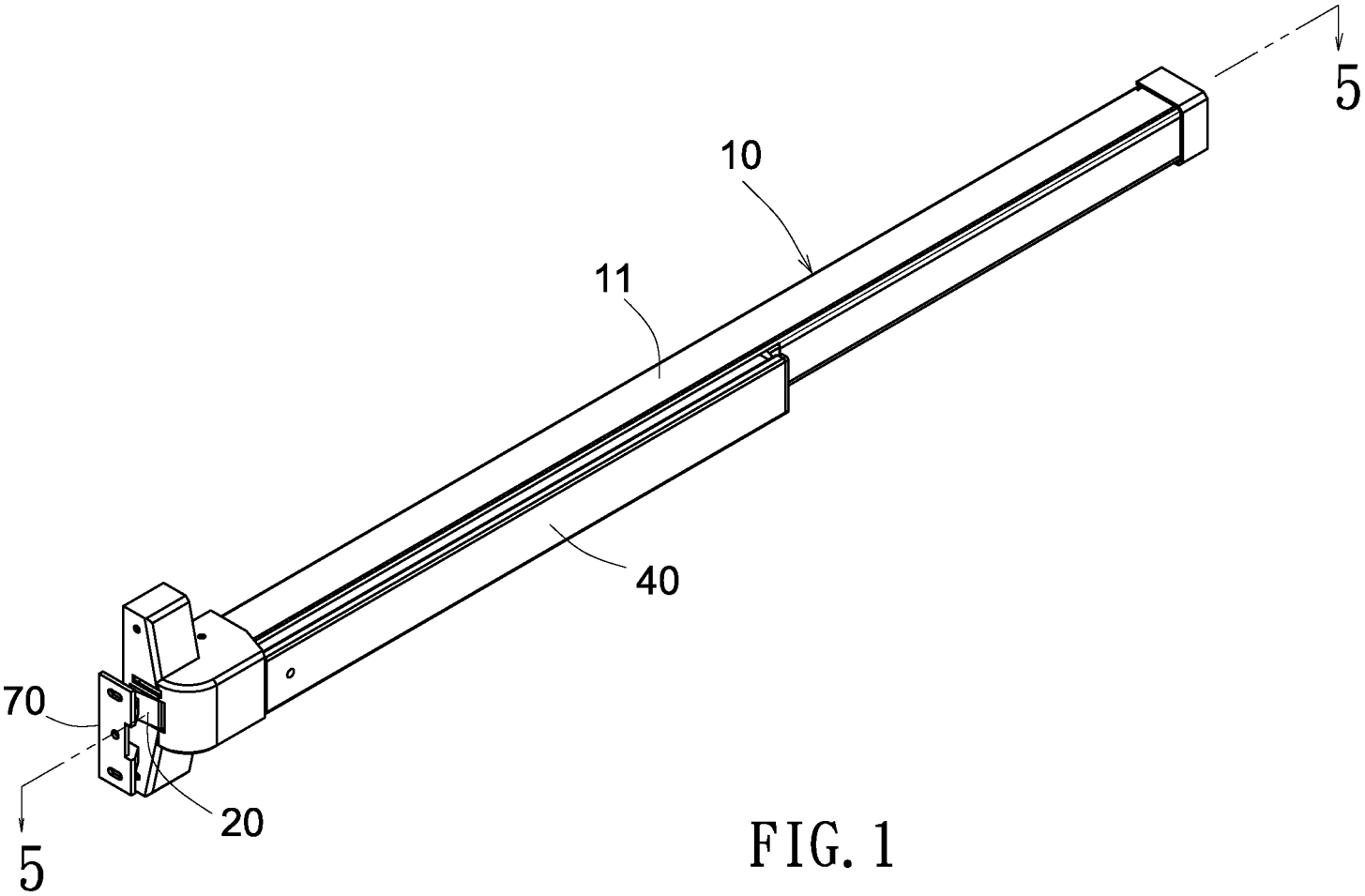
FIG. 1 is a perspective view showing the present invention.
Figure 2:
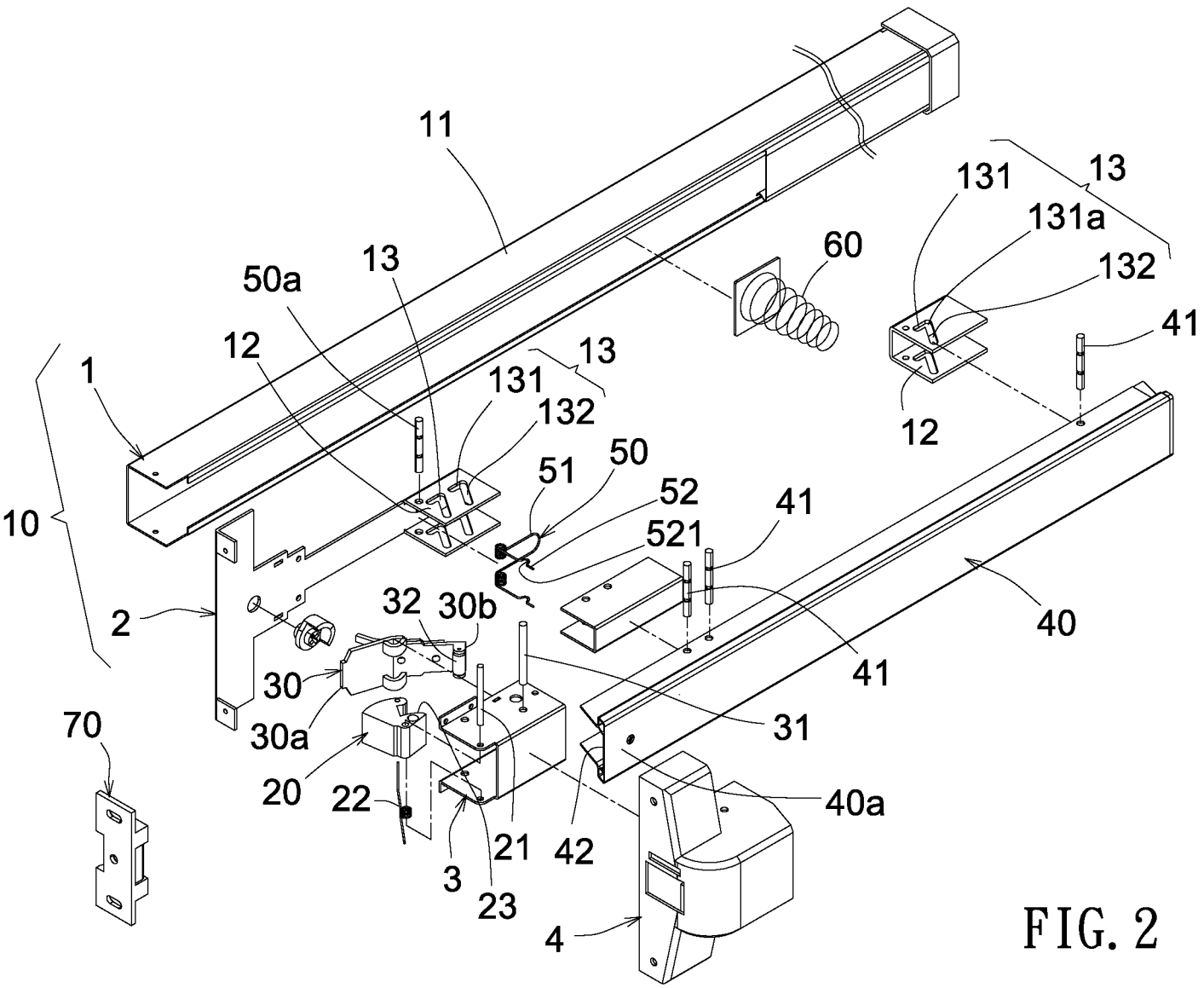
FIG. 2 is an exploded view showing the present invention.
Figure 3:
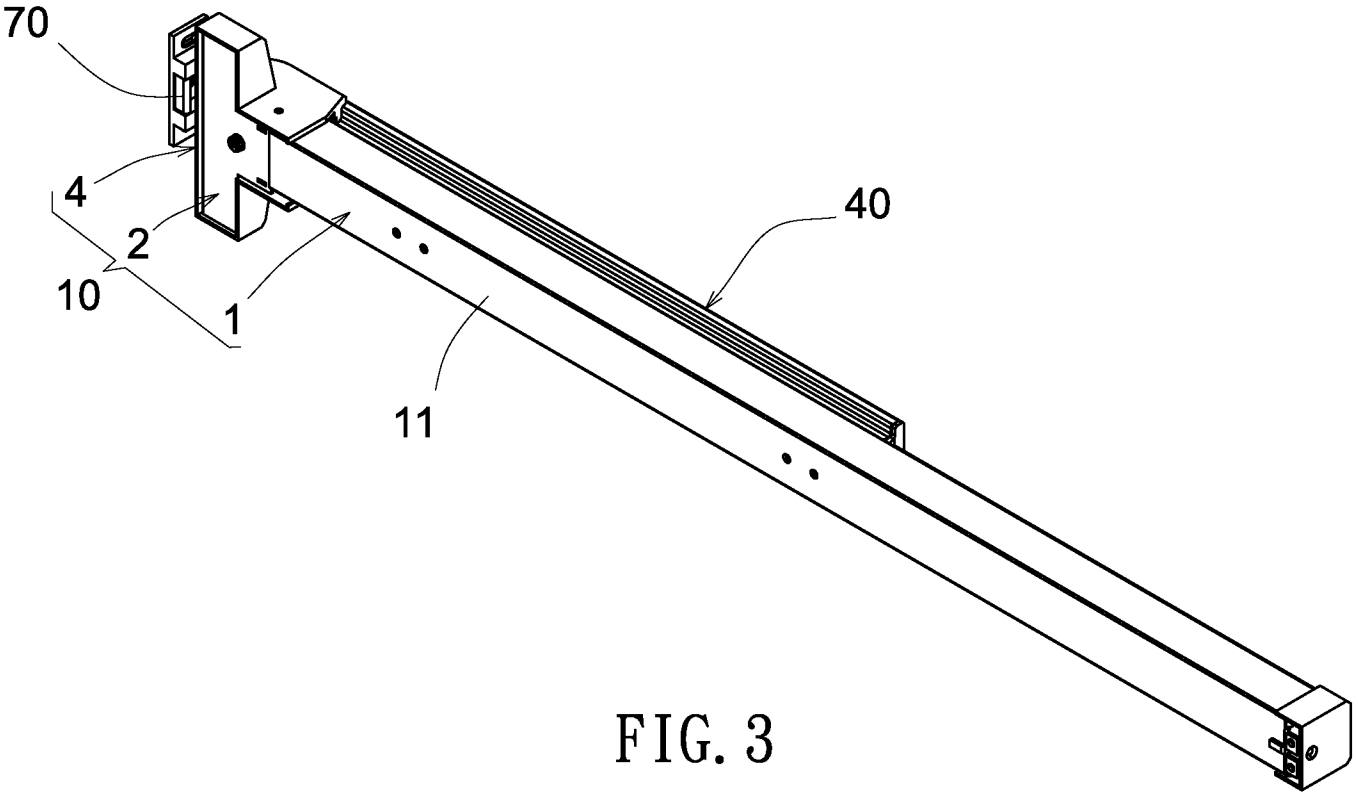
FIG. 3 is a perspective view showing the present invention from a back side.

In the knob-less horizontal-shift fire door lock disclosed in the present invention, as shown in FIG. 2, the base 10 is formed of multiple metal plates 1, 2, 3, 4 that are interconnected or welded together. The present invention is not limited to such.

In the knob-less horizontal-shift fire door lock disclosed in the present invention, the push board 30 is integrally formed through stamping or pressing a metal plate, and the present invention is not limited to such. As shown in FIGS. 2 and 5, the push board 30 of present invention is provided with a roller 32 rotatably mounted to the second end 30*b*, and the roller 32 is set in rolling contact engagement with an inner side of the first end 40*a* of the handle bar 40.

As shown in FIG. 5, in the knob-less horizontal-shift fire door lock disclosed in the present invention, an inner side of the handle bar 40 is provided, on a portion thereof in contact with the roller 32, with a pad 42 for contact engagement with the roller 32 in order to protect the inner side of the handle bar 40 against wear and abrasion for long term operation so as to increase a product lifespan.

As shown in FIG. 5, in the knob-less horizontal-shift fire door lock disclosed in the present invention, the included angle A formed between the horizontal groove 131 and the guide groove 132 is less than or equal to 90 degrees, and preferably 50-60 degrees in the present invention.

As shown in FIGS. 2 and 5, the knob-less horizontal-shift fire door lock according to the present invention further comprises a torsion spring 50, and the torsion spring 50 is mounted by a locating pin 50*a* to the unlocked-state positioning member 12, and the torsion spring 50 comprises a first spring segment 51 and a second spring segment 52, wherein the first spring segment 51 is supported on and by a fixed object (such as a sidewall of the unlocked-state positioning member 12), while the second spring segment 52 is elastically supported on and by the guide pin 41 in order to normally bias and push the guide pin 41 outwards, and thus, simultaneously biasing and elastically pushing the handle bar 40 outwards.

As shown in FIG. 5, the second spring segment 52 is formed with a positioning notch 521, and consequently, when the guide pin 41 slides to a top end 132*a* of the guide groove 132, the guide pin 41 falls into and is thus positioned in the positioning notch 521, and an effect of secured positioning is achieved.

As shown in FIGS. 2 and 5, in the knob-less horizontal-shift fire door lock disclosed in the present invention, at least one return spring 60 is arranged between the longitudinal bar 11 and the handle bar 40, and each return spring 60 normally pushes the handle bar 40 outward in a horizontal direction. The return spring 60 can be conic compression spring, and present invention is not limited to such.

In the knob-less horizontal-shift fire door lock disclosed in the present invention, the latch 20 comprises a push surface 23, and the push surface 23 is located on a moving path of the first end 30*a* of the push board 30, and a part of a free end of the latch 20 is normally and elastically ejected out of the base 10, such that in a door locked state, the push surface 23 of the latch 20 is in contact engagement with the first end 30*a* of the push board 30 to make the second end 30*b* of the push board 30 contacting and supporting the inner side of the handle bar 40. Or, alternatively, the present invention may be structured such that the push board 30 is normally acted upon by a spring (not shown) to bias the second end 30*b* of the push board 30 to contact and support the inner side of the first end 40*a* of the handle bar 40. The spring can be torsion spring mounted between the axle 31 and the push board 30, or an extension spring arranged between the push board 30 and a fixed terminal. The present invention is not limited to such.

In the knob-less horizontal-shift fire door lock according to the present invention, as shown in FIGS. 2 and 5, the base 10 is provided, in the range of the longitudinal bar 11, with two or more than two of unlocked-state positioning members 12, which, in a preferred embodiment, are arranged equally to correspond to two ends of the handle bar 40; however, the present invention is not limited to such.

Figure 8:
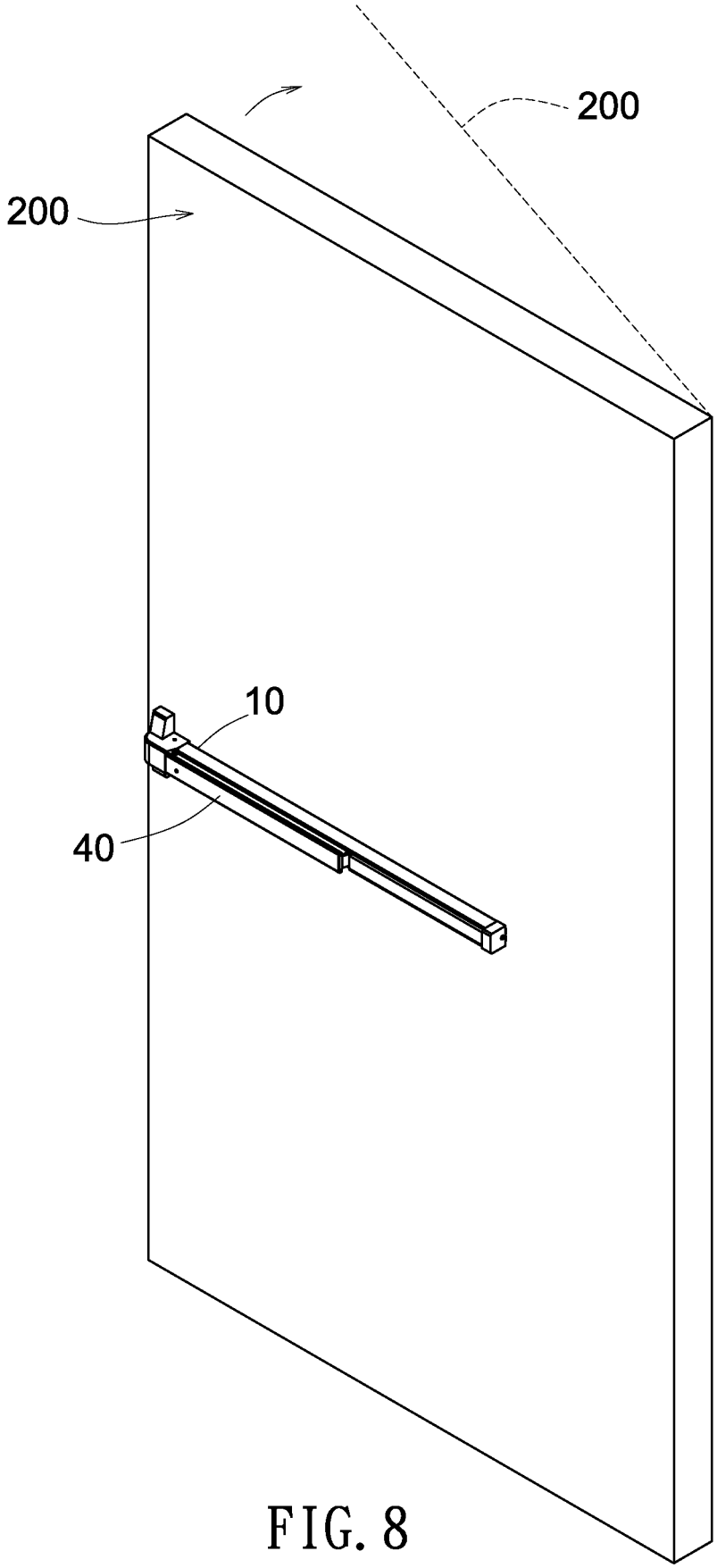
FIG. 8 is a schematic view showing the present invention mounted to a fire door.

In the operation of the present invention, in a locked and door-closed condition in which the latch 20 is elastically ejected outward as shown in FIGS. 4 and 5, an operator may push or press down the handle bar 40 in a direction toward the longitudinal bar 11 to a condition shown in FIG. 6, and under such a condition, the guide pin 41 of the handle bar 40 is slid and moved along the guide groove 132 toward the entry opening 131*a* of the horizontal groove 131, and the first end 40*a* of the handle bar 40 pushes the second end 30*b* of the push board 30 backwards to cause the push board 30 to rotate about the axle 31, and simultaneously, the first end 30*a* of the push board 30 drives the latch 20 backwards to have the latch 20 retracting inwards thereby disengaging from and being unlocked from the keeper 70 mounted to a door jamb so as to become an unlocked state, and the operator can push the fire door 200 outward as indicated by the phantom line of FIG. 8.

Figure 7:
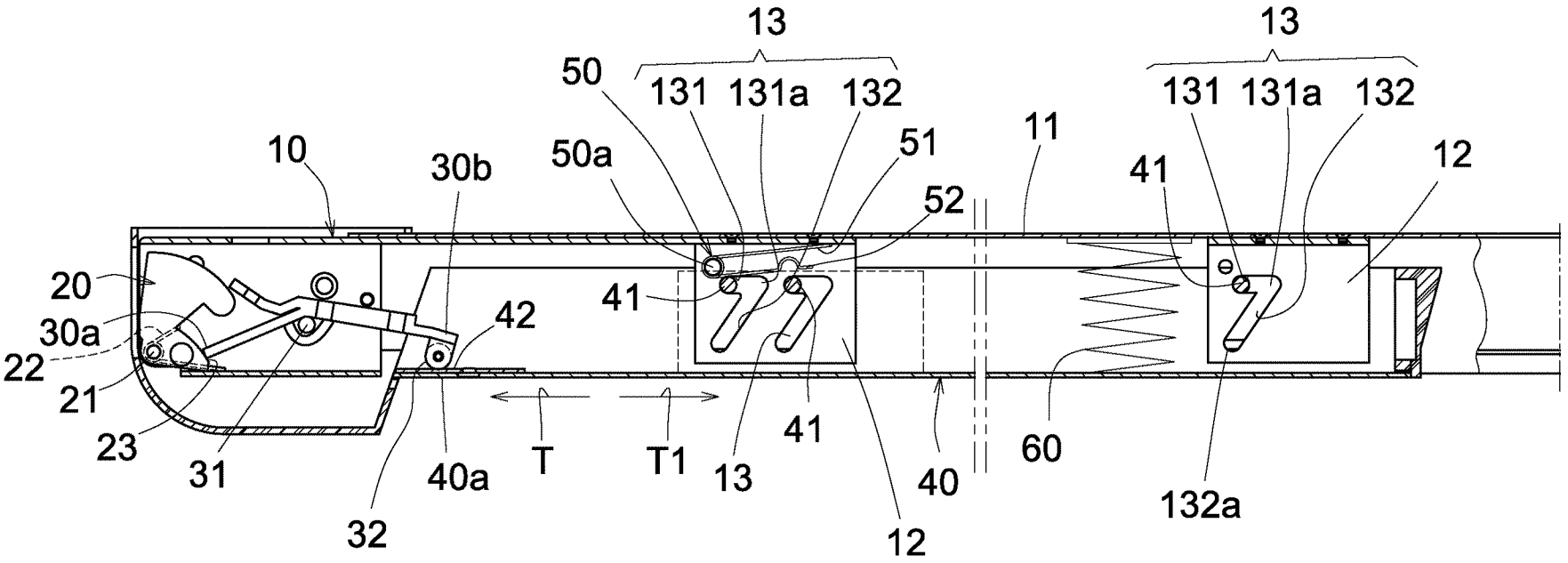
FIG. 7 is a schematic view showing a condition of being positioned in a locked state by horizontally shifting the handle bar of FIG. 6.

In the unlocked state as shown in FIG. 6, the operator may horizontally move and shift the handle bar 40 in T direction shown in FIG. 7, so that the guide pin 41 of the handle bar 40 is slid and moved into the horizontal groove 131 as shown in FIG. 7. Under this condition, even the operator releases the handle bar 40, due to the guide pin 41 being constrained by the horizontal groove 131, the handle bar 40 is not allowed to move and cannot be ejected outwards, so that the handle bar 40 is kept in a securely positioned condition, and also keeps the first end 30*a* of the push board 30 in a condition of retracting the latch 20 to stay in the unlocked state.

In the condition shown in FIG. 7, the operator may horizontally move and shift the handle bar 40 in T1 direction, causing the guide pin 41 to move back to the entry opening 131*a* of the horizontal groove 131 as shown in FIG. 6, and then releases the handle bar 40, so that the torsion spring 50 or the return spring 60 drives and ejects the handle bar 40 outwards to make the handle bar 40 no longer pushing and pressing down the second end 30*b* of the push board 30, and under such a condition, the spring 22 of the latch 20 operates to return the latch 20, making the latch 20 extending and projecting out of the base 10 to resume the locked state shown in FIG. 5.

In the knob-less horizontal-shift fire door lock provided in the present invention, the operator uses the same hand that pushes and depresses down the handle bar 40 to horizontally move and shift the handle bar 40 to set the latch 20 in a locked position. Thus, there is no need to change hand posture in operation, making it extremely ergonomic, and this demonstrates novelty and inventiveness of the present invention.

The structure and shape disclosed in the present invention can be further modified and altered without departing from the spirit and scope of the present invention defined in the following claims. The present invention is not limited to the embodiments described above.

I claim:

1. A knob-less horizontal-shift fire door lock, comprising:

a base, which comprises a longitudinal bar, at least one unlocked-state positioning member being arranged in a range of the longitudinal bar, each of the at least one unlocked-state positioning member being provided with at least one positioning section, the at least one positioning section being formed of a horizontal groove and a guide groove that are set in communication with each other as a group, the horizontal groove being parallel to the longitudinal bar, an included angle being formed between the horizontal groove and the guide groove;

a latch, which is pivotally mounted, by means of a pivot pin, to a first end of the base, the latch being biased and elastically supported by a spring, such that a part of a free end of the latch is normally biased out of the base;

a push board, which is pivotally mounted, at a middle section thereof, in the base by an axle; and a handle bar, which is slidably mounted on the longitudinal bar, the handle bar being at least provided with one guide pin, the guide pin being movable in unison with the handle bar, the guide pin extending through the positioning section, the handle bar being normally biased by at least one elastic element to eject outwards and moving the guide pin to slide into the guide groove, wherein the handle bar is depressible in a direction toward the longitudinal bar and the first end of the handle bar is caused to push and move a second end of the push board such that a first end of the push board is moved to drive the latch to retract inwards into the base to achieve an unlocked state, and the guide pin is caused to slide along the guide groove toward an entry opening of the horizontal groove, wherein the handle bar is horizontally shiftable to cause the guide pin to further slide into the horizontal groove to have the handle bar locked in position and keeping the latch staying in the unlocked state.

2. The knob-less horizontal-shift fire door lock according to claim 1, wherein the push board is provided with a roller rotatably mounted to the second end thereof to be in rolling contact engagement with an inner side of the handle bar at the first end thereof.

3. The knob-less horizontal-shift fire door lock according to claim 2, wherein the inner side of the handle bar is provided, on a portion thereof in contact engagement with the roller, with a pad for contact engagement with the roller.

4. The knob-less horizontal-shift fire door lock according to claim 1, wherein the included angle formed between the horizontal groove and the guide groove is less than or equal to 90 degrees.

5. The knob-less horizontal-shift fire door lock according to claim 1, further comprising a torsion spring, the torsion spring being mounted on the unlocked-state positioning member by a locating pin, the torsion spring comprising a first spring segment and a second spring segment, wherein the first spring segment is supported on a fixed object, and the second spring segment elastically supports the guide pin in order to normally bias and push the guide pin outwards.

6. The knob-less horizontal-shift fire door lock according to claim 5, wherein the second spring segment is formed with a positioning notch, so that when the guide pin slides to a top end of the guide groove, the guide pin falls into the positioning notch.

7. The knob-less horizontal-shift fire door lock according to claim 1, wherein the latch comprises a push surface, and the push surface is located on a moving path of the first end of the push board.

8. The knob-less horizontal-shift fire door lock according to claim 1, wherein the part of the free end of the latch is normally biased out of the base such that a push surface of the latch is in contact engagement with the first end of the push board to set the second end of the push board in contact engagement with an inner side of the handle bar.

9. The knob-less horizontal-shift fire door lock according to claim 1, wherein at least one return spring is arranged between the longitudinal bar and the handle bar, and the return spring normally biases the handle bar outwards.

10. The knob-less horizontal-shift fire door lock according to claim 1, wherein the push board is normally acted upon by a spring so as to drive the second end of the push board to get into contact engagement with an inner side of the first end of the handle bar.

11. The knob-less horizontal-shift fire door lock according to claim 1, wherein the base is provided, in the range of the longitudinal bar, with two or more than two unlocked-state positioning members.

* * * * *